US009290885B2

(12) United States Patent
Kim et al.

(10) Patent No.: US 9,290,885 B2
(45) Date of Patent: Mar. 22, 2016

(54) LAUNDRY TREATMENT APPARATUS

(71) Applicant: LG ELECTRONICS INC., Seoul (KR)

(72) Inventors: Hyojun Kim, Seoul (KR); Injae Han, Seoul (KR); Sangwook Hong, Seoul (KR); Youngsuk Kim, Seoul (KP)

(73) Assignee: LG ELECTRONICS INC., Seoul (KR)

( * ) Notice: Subject to any disclaimer, the term of this patent is extended or adjusted under 35 U.S.C. 154(b) by 14 days.

(21) Appl. No.: 14/163,841

(22) Filed: Jan. 24, 2014

(65) Prior Publication Data

US 2014/0208604 A1 Jul. 31, 2014

(30) Foreign Application Priority Data

Jan. 25, 2013 (KR) ..... 10-2013-0008499
Jan. 25, 2013 (KR) ..... 10-2013-0008501
Jan. 25, 2013 (KR) ..... 10-2013-0008615
Feb. 6, 2013 (KR) ..... 10-2013-0013293

(51) Int. Cl.

*D06F 58/20* (2006.01)
*D06F 58/22* (2006.01)
*D06F 58/26* (2006.01)
*D06F 29/00* (2006.01)

(Continued)

(52) U.S. Cl.

CPC ..... *D06F 58/22* (2013.01); *D06F 25/00* (2013.01); *D06F 29/005* (2013.01); *D06F 58/02* (2013.01); *D06F 58/20* (2013.01); *D06F 58/26* (2013.01); *D06F 37/266* (2013.01)

(58) Field of Classification Search

CPC ..... D06F 58/00; D06F 58/12; D06F 58/20; F26B 11/00; F26B 21/00; F26B 21/06

USPC ..... 34/595, 601, 606, 610; 68/5 C, 5 R, 19, 68/20; 8/149, 159

See application file for complete search history.

(56) References Cited

U.S. PATENT DOCUMENTS 3,250,097 A 5/1966 Czech
3,882,613 A * 5/1975 Wilson ..... 34/552

(Continued)

FOREIGN PATENT DOCUMENTS

EP 2 230 349 A1 9/2010
EP 2 319 979 A1 5/2011

(Continued)

OTHER PUBLICATIONS

International Search Report dated Apr. 29, 2014 issued in related application No. PCT/KR 2014/000563.

(Continued)

*Primary Examiner* — Stephen M Gravini
(74) *Attorney, Agent, or Firm* — Ked & Associates, LLP

(57) ABSTRACT

A laundry treatment apparatus may include a cabinet defining an external appearance of the apparatus, the cabinet having a laundry opening, a laundry accommodation module provided within the cabinet to receive laundry introduced through the laundry opening, a suction duct into which interior air from the laundry accommodation module may be introduced, a discharge duct from which the air is discharged into the laundry accommodation module, a connection duct connecting the suction duct and the discharge duct to each other, a heat exchanger provided in the connection duct, and a blower provided between the heat exchanger and the discharge duct to circulate the interior air of the laundry accommodation module.

20 Claims, 12 Drawing Sheets

(51) Int. Cl.

| | |
|---|---|
| ***D06F 58/02*** | (2006.01) |
| ***D06F 25/00*** | (2006.01) |
| *D06F 37/26* | (2006.01) |

(56) References Cited

U.S. PATENT DOCUMENTS

| | | | | |
|---|---|---|---|---|
| 4,665,628 | A * | 5/1987 | Clawson | 34/449 |
| 5,097,606 | A | 3/1992 | Harmelink et al. | |
| 5,101,575 | A | 4/1992 | Bashark | |
| 5,906,056 | A | 5/1999 | Noguchi et al. | |
| 6,530,245 | B1 | 3/2003 | Kawabata et al. | |
| 6,539,753 | B1 | 4/2003 | Ito et al. | |
| 6,941,680 | B1 | 9/2005 | Zielewicz et al. | |
| 6,966,126 | B2 * | 11/2005 | Baurmann | 34/606 |
| 7,146,749 | B2 | 12/2006 | Barron et al. | |
| 7,228,647 | B2 | 6/2007 | Hong | |
| 7,503,127 | B2 | 3/2009 | Duval et al. | |
| 7,921,578 | B2 * | 4/2011 | McAllister et al. | 34/597 |
| 8,028,439 | B2 | 10/2011 | Prajescu | |
| 8,240,064 | B2 * | 8/2012 | Steffens | 34/480 |
| 8,434,243 | B2 | 5/2013 | Kim et al. | |
| 8,572,865 | B2 | 11/2013 | Beers et al. | |
| 2003/0025395 | A1 | 2/2003 | Peterson | |
| 2004/0010937 | A1 | 1/2004 | Naganawa et al. | |
| 2004/0079121 | A1 | 4/2004 | Yabuuchi et al. | |
| 2005/0076535 | A1 | 4/2005 | Guinibert et al. | |
| 2006/0096334 | A1 | 5/2006 | Habu et al. | |
| 2006/0201014 | A1 * | 9/2006 | Favret et al. | 34/82 |
| 2006/0277690 | A1 | 12/2006 | Pyo et al. | |
| 2007/0068036 | A1 | 3/2007 | Choi | 34/528 |
| 2007/0180728 | A1 | 8/2007 | Kim et al. | |
| 2009/0139110 | A1 | 6/2009 | Oh et al. | |
| 2009/0178442 | A1 | 7/2009 | Kawabata et al. | |
| 2011/0005096 | A1 * | 1/2011 | Stolze | 34/468 |
| 2011/0016928 | A1 * | 1/2011 | Beihoff et al. | 68/19 |
| 2011/0030238 | A1 * | 2/2011 | Nawrot et al. | 34/499 |
| 2012/0000087 | A1 | 1/2012 | Da Riol et al. | |
| 2012/0030960 | A1 | 2/2012 | Ryoo et al. | |
| 2012/0044650 | A1 | 2/2012 | Kim et al. | |
| 2012/0090189 | A1 | 4/2012 | Kwon et al. | 34/82 |
| 2012/0246960 | A1 | 10/2012 | Lee et al. | 34/86 |
| 2013/0174433 | A1 | 7/2013 | Kim et al. | |
| 2014/0208604 | A1 * | 7/2014 | Kim et al. | 34/82 |
| 2014/0208609 | A1 * | 7/2014 | Han et al. | 34/549 |
| 2014/0250710 | A1 | 9/2014 | Yang et al. | |
| 2014/0360040 | A1 * | 12/2014 | Sartor et al. | 34/82 |
| 2015/0033806 | A1 | 2/2015 | Cerrato et al. | |

FOREIGN PATENT DOCUMENTS

| | | | |
|---|---|---|---|
| EP | 2 351 883 | A2 | 8/2011 |
| EP | 2573252 | A1 | 3/2013 |
| JP | 2005-137646 | A | 6/2005 |
| JP | 2010-035894 | A | 2/2010 |
| KR | 10-2006-0040338 | A | 5/2006 |
| KR | 10-2006-0107037 | A | 10/2006 |
| KR | 10-2010-0120055 | A | 11/2010 |
| WO | WO 2006/001620 | A1 | 1/2006 |
| WO | WO 2014/115999 | A1 | 7/2014 |

OTHER PUBLICATIONS

International Search Report dated May 7, 2014 issued in related application No. PCT/KR 2014/000548.

International Search Report dated May 20, 2014 issued in related application No. PCT/KR 2014/000543.

U.S. Office Action issued in U.S. Appl. No. 14/163,823 dated Jul. 24, 2015.

U.S. Notice of Allowance issued in U.S. Appl. No. 14/163,854 dated Jul. 24, 2015.

* cited by examiner

LAUNDRY TREATMENT APPARATUS

CROSS-REFERENCE TO RELATED APPLICATION(S)

This application claims priority under 35 U.S.C. §119 to Korean Application Nos. 10-2013-0008501 filed in Korea on Jan. 25, 2013, 10-2013-0008615 filed in Korea on Jan. 25, 2013, 10-2013-0008499 filed in Korea on Jan. 25, 2013, and 10-2013-0013293 filed on Feb. 6, 2013, whose entire disclosure(s) is/are hereby incorporated by reference.

BACKGROUND

1. Field

This relates to a laundry treatment apparatus.

2. Background

Laundry treatment apparatuses may wash and/or dry laundry, and may include, for example, washing machines, drying machines, and combination washing and drying machines. A laundry treatment apparatus capable of drying laundry may supply high temperature air (hot air), and may include exhaust type laundry treatment apparatuses and a circulation type (condensation type) laundry treatment apparatuses, based on an air flow method employed.

A circulation type laundry treatment apparatus, which recirculates air from a laundry accommodation space in which laundry is received, may remove moisture (dehumidify) air discharged from the laundry accommodation space, and heat and resupply the air back into the laundry accommodation space. An exhaust type laundry treatment apparatus may supply heated air into a laundry accommodation space and exhaust air discharged from the laundry accommodation space to the outside of the laundry treatment apparatus, rather than resupplying the air back into the laundry accommodation space.

A hot air supply device employed in a laundry treatment apparatus as described above may include a blower that discharges air from the laundry accommodation space and a heat exchanger that heats air moved by the blower. The blower may be located in front of the heat exchanger, such that air discharged from the laundry accommodation space sequentially passes through the blower and the heat exchanger and is resupplied into the laundry accommodation space. If the air discharged from the laundry accommodation space passes through only a portion of the heat exchanger, heat exchange efficiency of the laundry treatment apparatus may be impacted.

BRIEF DESCRIPTION OF THE DRAWINGS

The embodiments will be described in detail with reference to the following drawings in which like reference numerals refer to like elements wherein.

DETAILED DESCRIPTION

Figure 1:
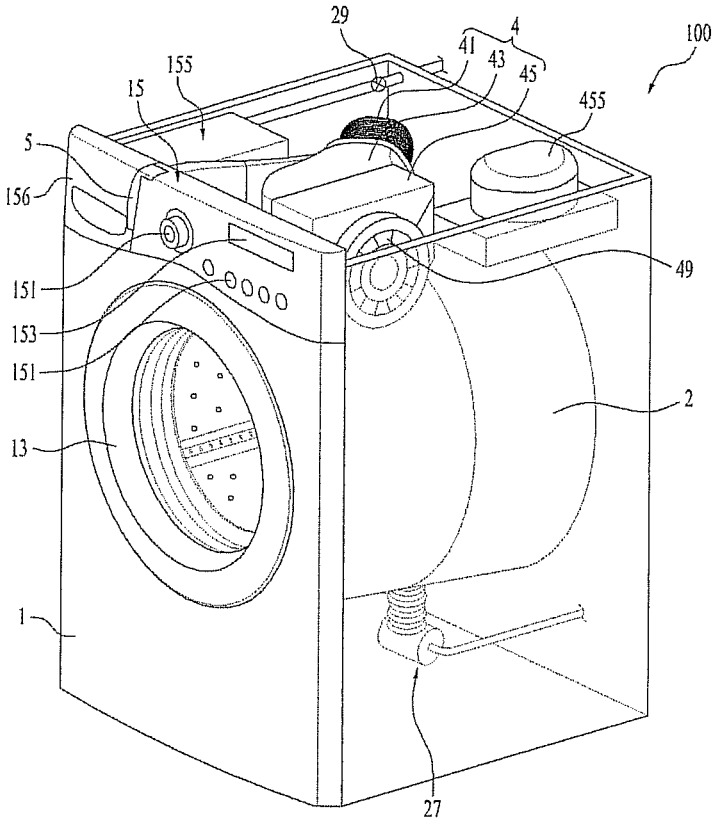
FIG. 1 is a perspective view of a laundry treatment apparatus according to an embodiment as broadly described herein.

Hereinafter, exemplary embodiments will be described in detail with reference to the accompanying drawings. A configuration and a control method of an apparatus that will be described hereinafter are provided for explanation of the exemplary embodiments and are not intended to limit the technical scope as broadly described herein. The same reference numerals will be used throughout to designate the same or similar constituent elements wherever possible.

Figure 2:
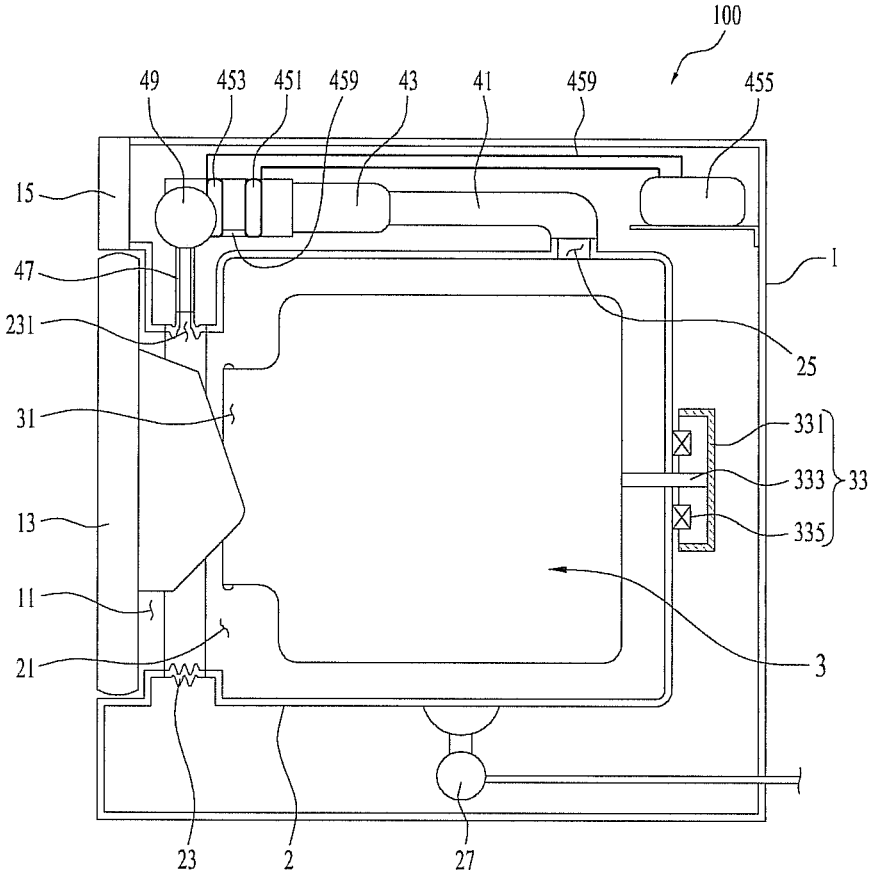
FIG. 2 is a side sectional view of the laundry treatment apparatus shown in FIG. 1.

As shown in FIGS. 1 and 2, a laundry treatment apparatus 100 as embodied and broadly described herein may include a cabinet 1 defining an external appearance of the apparatus 100, a laundry accommodation module, or laundry receiving device, within the cabinet 1 and configured to receive store laundry therein, and a hot air supply device 4 (hot air supply module) configured to supply hot air into the laundry accommodation module.

The cabinet 1 may have a laundry opening 11 through which laundry is introduced or removed, and a door 13 rotatably coupled to the cabinet 1 to open or close the laundry opening 11.

A control panel 15 may be coupled to the cabinet 1, for example, above the laundry opening 11 or other location as appropriate. The control panel 15 may include, for example, an input device 151 for input of a control instruction to operate the laundry treatment apparatus 100 and a display device 153 for display of control details of the laundry treatment apparatus 100.

The input device 151 provided at the control panel 15 may include an array of buttons or a rotary knob, and may transmit a received control instruction to a controller. Such a control instruction may be related to washing or drying programs preset in the laundry treatment apparatus 100 (e.g., a washing course or a drying course), washing time, the quantity of wash water, the supply time of hot air, and the like.

The display device 153 may display, for example, the control instruction (e.g., a course name) input via the input device 151, and may provide information (e.g., residual time) as the laundry treatment apparatus 100 is operated in response to the received control instruction.

If the laundry treatment apparatus 100 is a drying machine having only a function of drying laundry, the laundry accommodation module may simply include a drum 3 rotatably received within the cabinet 1.

On the other hand, if the laundry treatment apparatus 100 is an apparatus capable of implementing both drying and washing of laundry, as shown in FIG. 2, the laundry accommodation module may include a tub 2 received within the cabinet 1 to store wash water therein and the drum 3 rotatably received within the tub 2 to store laundry therein.

For convenience of explanation, the following description will be based on a laundry accommodation device including both the tub 2 and the drum 3.

As shown in FIG. 2, the tub 2 may have a hollow cylindrical shape and may be fixed within the cabinet 1, with a tub opening 21 perforated in a front surface thereof to face the laundry opening 11 for introduction and removal of laundry.

A gasket 23 may be interposed between the tub opening 21 and the laundry opening 11 to prevent wash water stored in the tub 2 from leaking from the tub 2, and also to prevent vibration of the tub 2 generated during rotation of the drum 3 from being transferred to the cabinet 1. Accordingly, the gasket 23 may be formed of a vibration insulating material, such as rubber.

The tub 2 may be arranged parallel to the ground, on which the cabinet 1 is supported, as shown in the drawing, or may be tilted by a prescribed angle with respect to the ground. In the case in which the tub 2 is tilted by a prescribed angle with respect to the ground, an inclination angle of the tub 2 may be less than 90 degrees.

The tub 2 may also include an air discharge hole 25 perforated in an upper portion of a circumferential surface thereof for discharge of air from the tub 2.

Figure 3:
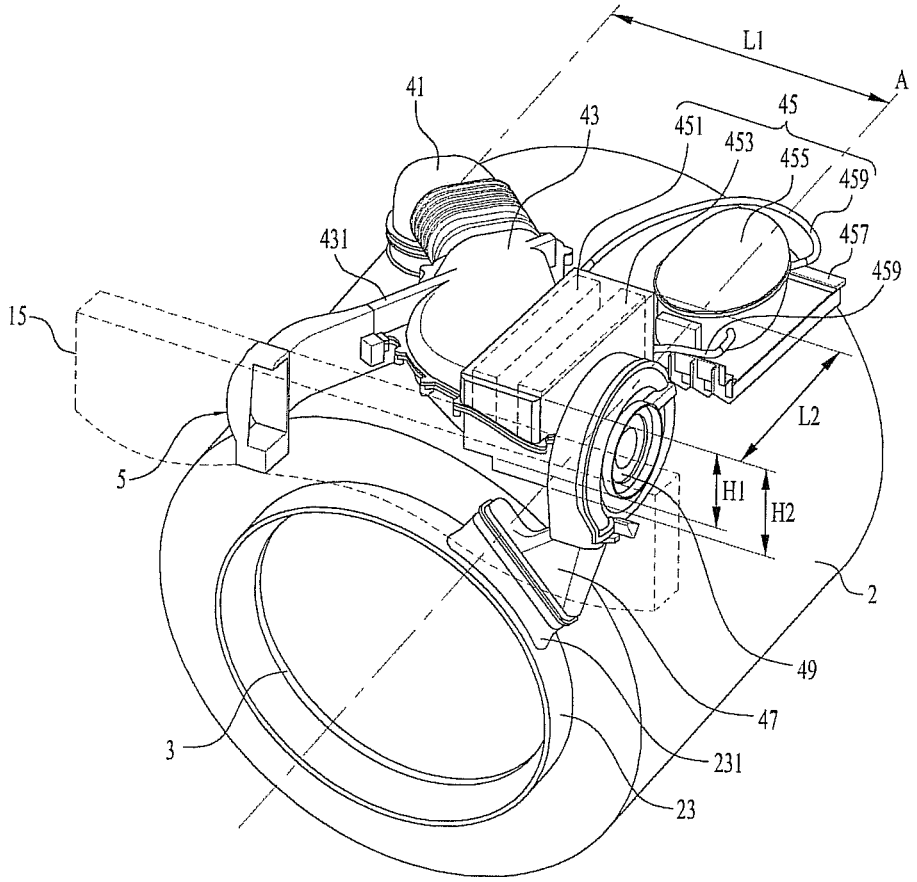
FIGS. 3 and 4A-4B are perspective views of a hot air supply device of the laundry treatment apparatus shown in FIGS. 1 and 2.

The air discharge hole 25 may be formed in a longitudinal direction of the tub 2 at a position spaced apart from an imaginary center line A of the tub 2 by a predetermined distance L1 (see FIG. 3). This may allow the interior air of the tub 2 to be easily discharged from the tub 2 through the air discharge hole 25 during rotation of the drum 3. In addition, when impurities inside the hot air supply device 4 are introduced into the tub 2 via an impurity removal device 6 that will be described hereinafter, the impurities may be moved to a lower surface of the tub 2 along an inner circumferential surface of the tub 2, which may prevent the impurities from being directed into the drum 3.

The laundry treatment apparatus 100 may include a water supply and drain device to supply wash water into the tub 2 and to discharge wash water stored in the tub 2. The water supply and drain device may include a water supply device 29 to supply wash water into the tub 2, and a drain device 27 installed at the bottom of the tub 2 to discharge wash water stored in the tub 2.

The water supply device 29 may supply water, supplied from an external water supply source into the tub 2. The water supply device 29 may include a water supply pipe connected to the water supply source and a water supply valve to open or close the water supply pipe.

Similarly, the drain device 27 may include a drain pipe communicating the interior of the tub 2 with the exterior of the cabinet 1, and an opening/closing device to open or close the drain pipe (e.g., a drain pump or a drain valve).

The drum 3 may have a hollow cylindrical shape and be received within the tub 2. The drum 3 may be rotated within the tub 2 by a drive system 33, or motor 33 installed at an outer rear surface of the tub 2. The motor 33 may include a stator 335 fixed to the rear surface of the tub 2, a rotor 331 configured to be rotated via electromagnetic interaction with the stator 335, and a rotating shaft 333 penetrating the rear surface of the tub 2 to connect the rotor 331 and a rear surface of the drum 3 to each other.

The drum 3 may include a drum opening 31 communicating with the laundry opening 11 and the tub opening 21. Thus, a user may introduce laundry into the drum 3 through the laundry opening 11, and remove laundry stored in the drum 3 from the cabinet 1.

If the laundry treatment apparatus 100 is capable of implementing both drying and washing of laundry, a detergent supply device 155 may be installed within the cabinet 1 to store detergent to be supplied into the tub 2. The detergent supply device 155 may include a reservoir 1551 (see FIG. 5) in the form of a drawer that may be withdrawn from the cabinet 1, a detergent supply pipe 1553 to guide detergent stored in the reservoir 1551 into the tub 2, and a reservoir handle 1555 located at one side of the control panel 15 to allow the user to withdraw the reservoir 1551 from the cabinet 1.

Water may be supplied into the reservoir 1551 from the external water supply source through the water supply device 29. Thus, once water has been supplied into the reservoir 1551 via the water supply source, detergent stored in the reservoir 1551 may be supplied, along with the water, into the tub 2 through the detergent supply pipe 1553.

As shown in FIG. 3, the hot air supply device 4 may include a circulation path, or circulation passage, 41, 43 and 47 configured to guide air discharged from the tub 2 to the front surface of the tub 2 (i.e. one surface of the tub 2 that faces the laundry opening 11), a heat exchanger 45 placed within the circulation passage, and a blower 49 installed to circulate the interior air of the tub 2.

The circulation passage may be defined so as to allow air discharged from a rear region of the tub 2 to be again introduced into the tub 2 through the front surface of the tub 2. FIG. 3 shows one example of the circulation passage, through which air is discharged from an upper rear portion of the circumferential surface of the tub 2 and is introduced into the tub 2 through an upper front portion of the circumferential surface of the tub 2.

The circulation passage may include a suction duct 41 fitted into the air discharge hole 25 of the tub 2, a connection duct 43 to connect the suction duct 41 and the blower 49, the heat exchanger 45 secured to the connection duct 43, and a discharge duct 47 to connect the blower 49 and the gasket 23.

The suction duct 41 may be a path into which the interior air of the tub 2 is discharged through the air discharge hole 25 perforated in a rear portion of the circumferential surface of the tub 2. The suction duct 41 may be formed of a vibration insulating material (e.g., rubber) to prevent vibration of the tub 2 generated during rotation of the drum 3 from being transferred to the connection duct 43 and the heat exchanger 45 through the suction duct 41.

To more efficiently prevent vibration of the tub 2 from being transferred to the connection duct 43 and the heat exchanger 45, the suction duct 41 may include bellows. The bellows may be formed along the entire suction duct 41, or may be formed at a portion of the suction duct 41 (i.e. a coupling portion with the connection duct 43).

The heat exchanger 45 may be a heat pump. In this case, the heat exchanger 45 may include an evaporator 451, a condenser 453, a compressor 455, and an expander (i.e. expansion valve). The evaporator 451 and the condenser 453 may be fixed within the connection duct 43, whereas the compressor 455 may be mounted at the outside of the connection duct 43. The compressor 455, the evaporator 451, the condenser 453, and the expander may be connected to each other via a refrigerant pipe 459, and circulation of refrigerant may be realized by the compressor 455.

If the heat exchanger 45 takes the form of a heat pump, the hot air supply device 4 may further include a compressor support member 457 installed at the exterior of the connection duct 43 to support the compressor 455. For example, the compressor support member 457 may be installed at the connection duct 43 to support the bottom of the compressor 455. With this configuration, the circulation path 41, 43 and 47, the heat exchanger 45, and the blower 49 of the hot air supply device 4 may constitute a single module (i.e. a hot air supply module).

More specifically, the suction duct 41, the connection duct 43 in which the evaporator 451 and the condenser 453 of the heat exchanger 45 are mounted, the discharge duct 47, and the blower 49 may be integrally assembled, whereas the compressor 455 of the heat exchanger 45 may be secured to the connection duct 43 via the compressor support member 457 that is also secured to the connection duct 43.

Provision of the hot air supply device 4 in the form of a module may ensure easy assembly of the hot air supply device 4 and the cabinet 1. In addition, through use of the hot air supply device 4 in the form of a module, connection of the evaporator 451 and the condenser 453 to the compressor 455 via the refrigerant pipe 459 may be more easily implemented than assembling respective constituent elements of the hot air supply device 4 within the cabinet 1.

In the evaporator 451, refrigerant is evaporated by absorbing heat from air introduced into the connection duct 43. Thereby, the evaporator 451 may implement cooling of the air as well as removal of moisture contained in the air (i.e. dehumidification and condensation of the air). As the interior air of the connection duct 43 is condensed while passing through the evaporator 451 as described above, condensed water may remain in the connection duct 43. This condensed water remaining in the connection duct 43 may be unintentionally directed to laundry during drying. Thus, the laundry treatment apparatus 100 may further include a device to discharge the condensed water from the connection duct 43.

Various shapes of structures may be adopted to discharge condensed water from the connection duct 43. In one example, a path to connect the connection duct 43 and the drain device 27 to each other may be provided.

In the condenser 453, the refrigerant may be condensed. As heat generated during condensation of the refrigerant is transferred to air passing through the condenser 453, the condenser 453 may heat the air passed through the evaporator 451.

The circulation path 41, 43 and 47, as shown in FIG. 3, may be arranged in a diagonal direction of an upper portion of the tub 2. In this case, the compressor 455 may be located in a space between the circulation path 41, 43 and 47 and the cabinet 1 in the space above the tub 2. This may contribute to efficient utilization of the space above the circumferential surface of the tub 2, thereby preventing an increase in the height or volume of the laundry treatment apparatus 100.

The discharge duct 47 may guide the air discharged from the connection duct 43 into the tub 2 through the blower 49. One end of the discharge duct 47 may be fixed to the blower 49 and the other end of the discharge duct 47 may be connected to a duct connection hole 231 formed in the gasket 23. To prevent vibration of the tub 2 generated during rotation of the drum 3 from being transferred to the blower 49 or the connection duct 43 through the discharge duct 47, at least one of the gasket 23 or the discharge duct 47 may be formed of a vibration insulating material (or an elastic material).

The blower 49 may be located between the heat exchanger 45 and the discharge duct 47. The blower 49 may cause air to pass through the heat exchanger 45 by generating negative pressure at the rear side of the heat exchanger 45 (toward the discharge duct 47), rather than generating positive pressure at the front side of the heat exchanger 45 (toward the suction duct 41).

Figure 4A:
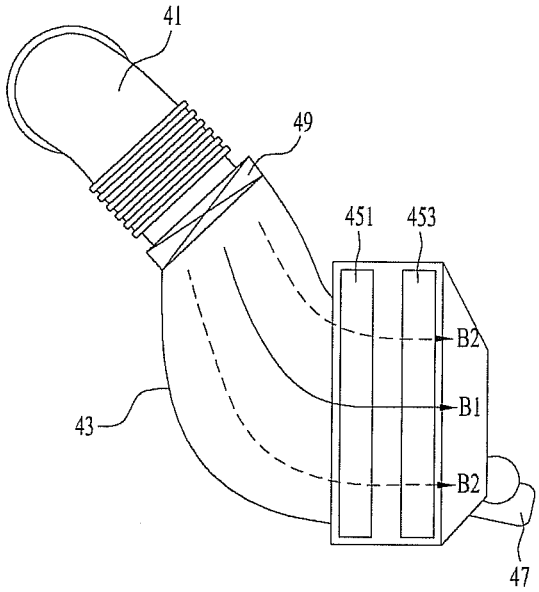

As shown in FIG. 4A, if the blower 49 generates positive pressure at the front side of the heat exchanger 45 to allow air to pass through the heat exchanger 45, some of the interior air of the connection duct 43 may be easily moved to the heat exchanger 45, but some of the air may not be easily moved to the heat exchanger 45.

That is, although most of the air discharged from the blower 49 is easily moved to the heat exchanger 45 (as represented by the arrow B1), some of the air discharged from the blower 49 may have difficulty in being rapidly moved to the heat exchanger 45 according to the shape of the connection duct 43 or the configuration of the blower 49 (as represented by the arrow B2).

For this reason, in the case in which the blower 49 is located in front of the heat exchanger 45 to forcibly blow air toward the heat exchanger 45 (to generate positive pressure at the front side of the heat exchanger 45), the flow rate of air per cross section of the connection duct 43 may be inconsistent according to a position of the connection duct 43, which may result in deterioration of heat exchange efficiency.

However, in the laundry treatment apparatus 100 as embodied and broadly described herein, the above-described problem may be solved as the blower 49 may be located between the heat exchanger 45 and the discharge duct 47 (to allow air to sequentially pass through the heat exchanger 45 and the blower 49).

Figure 4B:
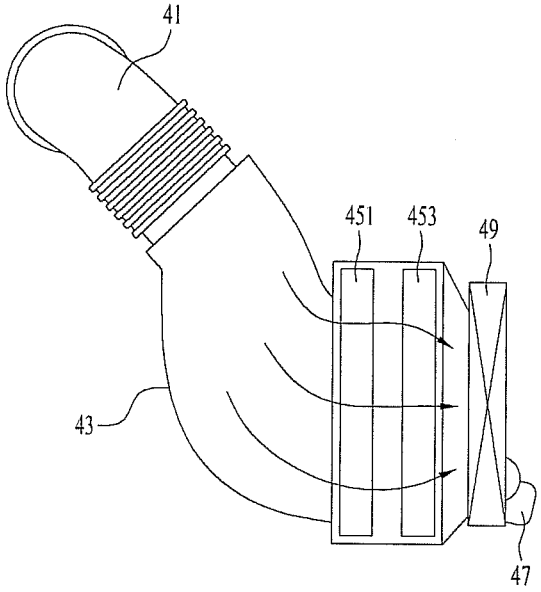

As shown in FIG. 4B, when the blower 49 is located between the heat exchanger 45 and the discharge duct 47, negative pressure is generated at the rear side of the heat exchanger 45. Such generation of negative pressure at the rear side of the heat exchanger 45 ensures that the air being moved to the heat exchanger 45 through the connection duct 43 has a constant flow rate throughout the cross section of the connection duct 43. Accordingly, the laundry treatment apparatus 100 may have higher heat exchange efficiency between the air and the heat exchanger 45 (i.e. achieve higher drying efficiency) than that achieved by the configuration of FIG. 4A.

As the connection duct 43 is disposed on an upper portion of the circumferential surface of the tub 2, there may be a difference between the size of a space in which the evaporator 451 is located and the size of a space in which the condenser 453 is located. That is, as shown in FIG. 3, a height H1 of the connection duct 43 with regard to an installation space of the evaporator 451 may be less than a height H2 of the connection duct 43 with regard to an installation space of the condenser 453.

If the connection duct 43 arranged in a longitudinal direction of the tub 2 has a constant width L2, due to the above-described difference between the height H1 of the installation space of the evaporator 451 and the height H2 of the installation space of the condenser 453, heat exchange capacity of any one component may limit heat exchange capacity of the other component. To prevent the above-described problem, an area ratio of the evaporator 451 to the condenser 453 may be within a range of 1:1.3 to 1:1.6.

Figure 5:
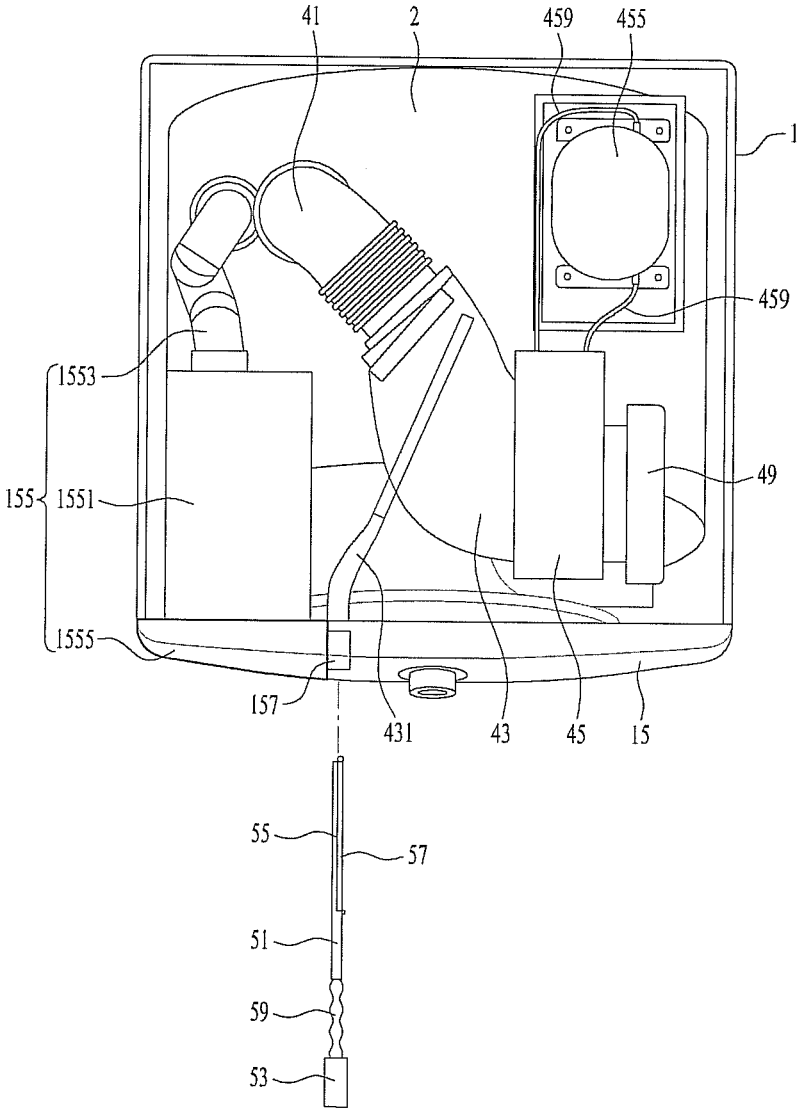
FIG. 5 is a plan view of the laundry treatment apparatus shown in FIGS. 1 and 2.

The laundry treatment apparatus 100 may further include a filter device 5 to filter the air discharged from the tub 2 to prevent impurities, such as lint, from being accumulated in the heat exchanger 45. As shown in FIG. 5, the filter device 5 may be separably coupled to the connection duct 43 by passing through the cabinet 1. To this end, the connection duct 43 may include a filter guide 431 to guide movement of the filter device 5, and the cabinet 1 may include a filter separation/coupling passage 157 through which the filter device 5 passes.

The filter guide 431 may communicate the interior of the connection duct 43 with the filter separation/coupling passage 157. More specifically, the filter guide 431 may include a section that protrudes from an outer circumferential surface of the connection duct 43 and is connected to the filter separation/coupling passage 157, and a section that is located inside the connection duct 43 and configured to receive only an edge of the filter device 5.

If the laundry treatment apparatus 100 does not include the detergent supply device 155, the filter separation/coupling passage 157 may be formed to penetrate the cabinet 1 or to penetrate the control panel 15.

On the other hand, if the laundry treatment apparatus 100 includes the detergent supply device 155, the filter separation/coupling passage 157 may be formed to penetrate the cabinet 1 in a space between the control panel 15 and the detergent supply unit 155 arranged parallel to each other.

Moreover, the filter separation/coupling passage 157 may be located above the laundry opening 11. This may allow the user to separate the filter device 5 from the laundry treatment apparatus 100 by less bending at the waist than the case in which the filter device 5 is located below the laundry opening 11, which may result in enhanced user convenience.

The filter guide 431 may connect the filter separation/coupling passage 157 and the connection duct 43 to each other. As such, the filter device 5 inserted into the filter separation/coupling passage 157 may be located between the suction duct 41 and the evaporator 451 under assistance of the filter guide 431.

Figure 6:
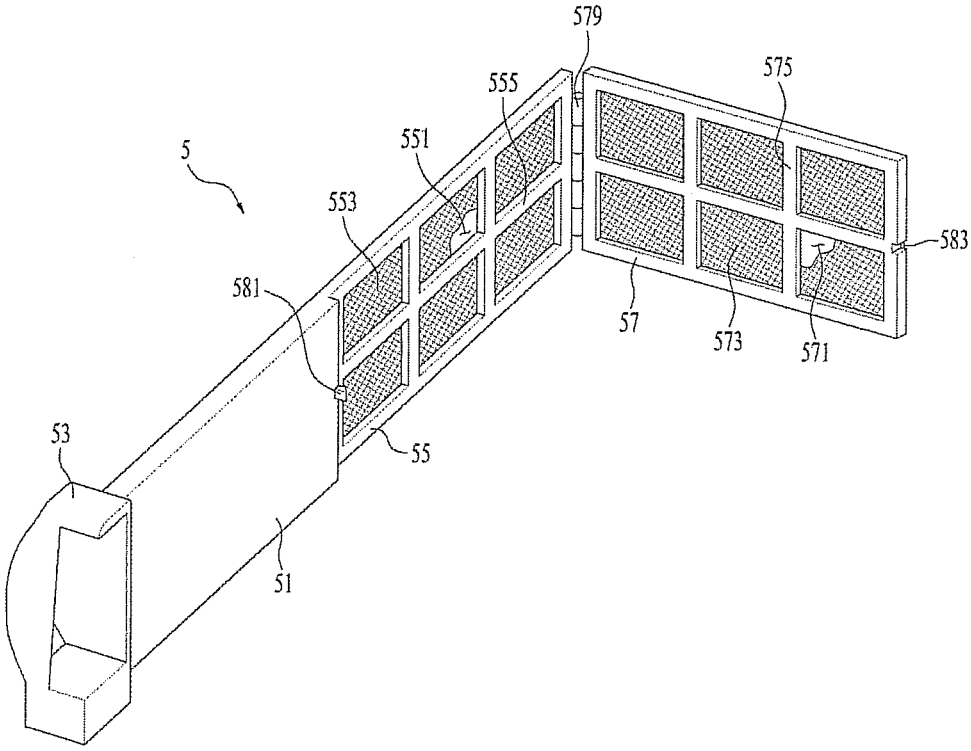
FIGS. 6 and 7 are perspective views of a filter device of the laundry treatment apparatus shown in FIGS. 1 and 2.

The above-described filter device 5, as shown in FIG. 6, may include a body 51 and filter frames 55 and 57 fixed to the body 51 and respectively provided with filters 553 and 573. A handle 53 may be installed on the body 51. The handle 53 may be seated in the filter separation/coupling passage 157 to assist the user in easily withdrawing or inserting the filter device 5 from or into the cabinet 1.

When the filter device 5 is inserted into the cabinet 1, the body 51 is located in the filter guide 431 and the filter frames 55 and 57 are located inside the connection duct 43.

The body 51 may be formed of an elastic material. This may allow the filter frames 55 and 57 to be coupled to or separated from the connection duct 43 if the filter separation/coupling passage 157 and the connection duct 43 are not arranged in a straight line perpendicular to the front surface of the cabinet 1. That is, as shown in FIG. 5, in the case in which the circulation path 41, 43 and 47 is arranged in a diagonal direction of the upper portion of the tub 2 (i.e. the connection duct 43 being located near the center of the upper portion of the tub 2) and the filter separation/coupling passage 157 is located in a lateral position of the front surface of the cabinet 1 (i.e. the filter separation/coupling passage 157 being spaced apart from the center of the upper portion of the tub 2), forming the body 51 of an elastic material may be necessary to allow the filter frames 55 and 57 to be easily moved into the connection duct 43.

The filter frames may include a first frame 55 integrated with the body 51, and a second frame 57 rotatably coupled to the first frame 55, the second frame 57 being separable from the body 51 or the first frame 55. The first frame 55 may include a through-hole 551, a first filter 553 installed in the through-hole 551 to filter air, and a support rib 555 installed in the through-hole 551 to support the first filter 553. The second frame 57 may have the same configuration as that of the first frame 55. Thus, the second frame 57 may include a through-hole 571, a second filter 573 installed in the through-hole 571, and a support rib 575 installed in the through-hole 571 to support the second filter 573.

The second frame 57 may be rotatably coupled to the first frame 55 via a hinge 579. The first filter 553 and the second filter 573 may be arranged to face each other (to overlap each other) when the first frame 55 and the second frame 57 overlap each other.

The filter device 5 may further include frame coupling portions 581 and 583 to secure the second frame 57 to the first frame 55. The frame coupling portions 581 and 583 may include a boss 581 formed at one of the body 51 or the second frame 57, and a receiving recess 583 formed in the other of the body 51 or the second frame 57 such that the boss 581 is inserted into the receiving recess 583. FIG. 6 shows one example in which the boss 581 is formed at the body 51 and the receiving recess 583 is formed in an outer periphery of the second frame 57.

The first frame 55 and the second frame 57 as described above may be formed of an elastic material.

Figure 7:
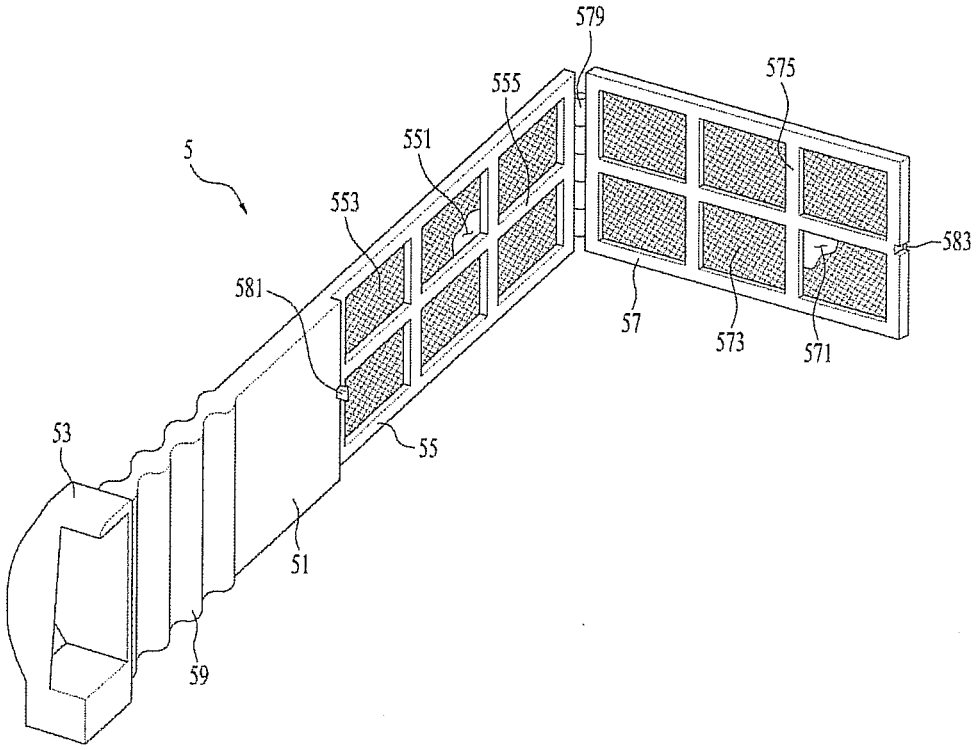

FIG. 7 shows another embodiment of the filter device 5. The filter device 5 according to the present embodiment may further include an elastic support portion 59 constituting a portion of the body 51.

FIG. 7 shows, by way of example, the case in which the elastic support portion 59 is a connection portion between the handle 53 and the body 51. Of course, differently from illustration of FIG. 7, the elastic support portion 59 may be provided at any position of the body 51.

For example, the elastic support portion 59 may be the entire body 51, may be a center portion of the body 51, or may be a connection portion between the body 51 and the first frame 55.

The elastic support portion 59 may have various configurations so long as it allows the filter frames 55 and 57 to be separable from the connection duct 43 when the filter separation/coupling passage 157 and the connection duct 43 are not arranged in a straight line perpendicular to the front surface of the cabinet 1.

FIG. 7 shows, by way of example, the case in which the elastic support portion 59 includes a plurality of corrugations formed at a surface of the body 51. In this case, the plurality of corrugations may be formed at opposite surfaces of the body 51.

Impurities remaining on the first filter 553 and the second filter 573 of the filter frames 55 and 57 may be removed by the impurity removal device 6.

Figure 8:
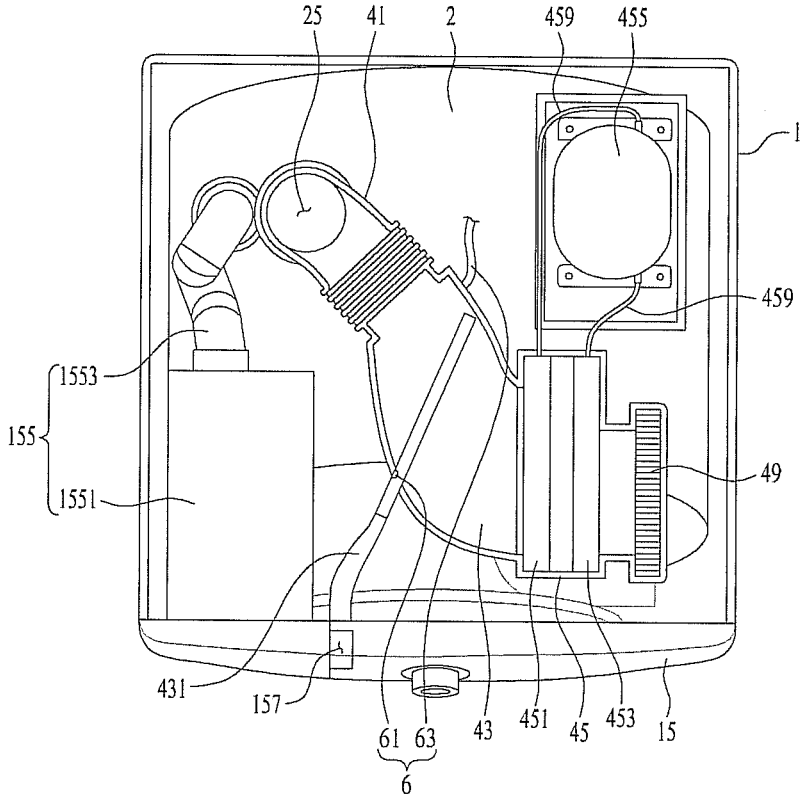
FIG. 8 is a plan view including an impurity removal device of the laundry treatment apparatus shown in FIGS. 1 and 2.

As shown in FIG. 8, the impurity removal device 6 may include a scraper 61 coupled to the filter guide 431 to separate impurities from the filters 553 and 573 when the filter frames 55 and 57 are withdrawn from or inserted into the connection duct 43. The scraper 61 may be installed within the filter guide 431 to come into contact with at least one of the first filter 553 or the second filter 573 when the filter frames 55 and 57 are withdrawn from the connection duct 43. More specifically, the scraper 61 may include a first scraper installed to come into contact with the first filter 553 and a second scraper installed to come into contact with the second filter 573 when the filter frames 55 and 57 are withdrawn from the connection duct 43. In this case, the first scraper and the second scraper may be arranged within the filter guide 431 to face each other.

If the first filter 553 is disposed to face the suction duct 41 and the second filter 573 is disposed to face the evaporator 451, the scraper 61 may come into contact with only the first filter 553. This is because most of impurities contained in the air introduced into the connection duct 43 are removed by the first filter 553.

The impurity removal device 6 may further include a water supplier 63, which supplies water into the connection duct 43 to discharge impurities remaining in the connection duct 43 to the outside of the connection duct 43.

If the user withdraws the filter device 5 from the cabinet 1 using the handle 53, impurities remaining on the filters 553 and 573 are separated from the filters 553 and 573 by the scraper 61 as the filter frames 55 and 57 are withdrawn from the connection duct 43. The impurities separated from the filters 553 and 573 remain in the connection duct 43. Thus, the water supplier 63 may connect the connection duct 43 and the water supply source provided inside or outside of the laundry treatment apparatus 100 to each other, thereby supplying water into the connection duct 43 to discharge the impurities remaining in the connection duct 43 to the outside of the tub 2.

The impurities may remain in the heat exchanger 45 or the blower 49 when the impurities remaining in the connection duct 43 are moved to the tub 2 by passing through the heat exchanger 45, the blower 49, and the discharge duct 47. Therefore, the water supplier 63 may eject water into the suction duct 41 to allow the impurities inside the connection duct 43 to be moved to the tub 2 through the suction duct 41. In this case, the impurities moved into the tub 2 may be discharged from the tub 2 to the outside of the cabinet 1 during operation of the drain device 27.

Of course, the impurities inside the connection duct 43 may be discharged from the connection duct 43 through a separate path that communicates the connection duct 43 with the outside of the cabinet 1 or a separate path that connects the connection duct 43 and the drain device 27 to each other.

Despite the presence of the filter device 5, impurities may still accumulate in the heat exchanger 45. For this reason, the water supplier 63 may supply water into the heat exchanger 45 to remove impurities remaining on a surface of the heat exchanger 45.

The impurities accumulated on the heat exchanger 45 may have higher possibility of accumulation on a surface of the evaporator 451 than possibility of accumulation on a surface of the condenser 453. Therefore, the water supplier 63 may include a nozzle configured to eject water to the evaporator 451 and a path that connects the nozzle and the water supply source to each other.

In this case, the nozzle may be oriented to obliquely eject water onto the surface of the evaporator 451 by a prescribed angle, and impurities separated from the surface of the evaporator 451 by the water ejected from the nozzle may be discharged outward from the cabinet 1 through the path that communicates the connection duct 43 with the outside of the cabinet 1 or the path that connects the connection duct 43 and the drain device 27 to each other.

The impurities separated from the surface of the evaporator 451 by the water ejected from the nozzle may be introduced into the tub 2 through the suction duct 41, and thereafter be discharged outward from the cabinet 1 through the drain device 27.

In embodiments as broadly described herein, the filter device 5 may be installed so as to be withdrawn from the cabinet 1 simultaneously with withdrawal of the detergent supply device 155.

Upon washing of laundry, the user may withdraw the detergent reservoir 1551 from the cabinet 1 to put detergent into the detergent reservoir 1551, and thereafter may introduce the detergent reservoir 1551 into the cabinet 1. Thus, by allowing the filter device 5 to be withdrawn from the cabinet 1 along with the detergent reservoir 1551, impurities remaining on the filter device 5 may be removed from the filter device 5 by the scraper 61 when the user withdraws the detergent reservoir 1551 from the cabinet 1 for washing of laundry. Accordingly, additional cleaning of the filter device 5.

Various structures to move the filter device 5 along with the detergent reservoir 1551 may be adopted. In one example, the body 51 of the filter device 5 may be connected to the detergent reservoir 1551. In this case, if the user withdraws the detergent reservoir 1551 from the cabinet, the filter device 5 may be automatically withdrawn from the cabinet 1.

The laundry treatment apparatus 100 may further include a sensor installed within the connection duct 43 at a position between the evaporator 451 and the condenser 453 to measure the temperature of air. The sensor may measure the temperature of air dehumidified inside the connection duct 43, and transmit the measured temperature to a controller. The controller may determine dryness of laundry by comparing measured temperature data with predetermined temperature data (experimentally set temperature data on a per dryness basis). The sensor may be located between the evaporator 451 and the condenser 453 to prevent impurities from being accumulated on the sensor, thereby preventing the sensor from failing to acquire accurate temperature data.

That is, impurities may be introduced into the evaporator 451 despite the presence of the filter device 5 used to filter air to be introduced into the evaporator 451. Thus, if the sensor is located in front of the evaporator 451, impurities may be accumulated on the sensor, thereby preventing the sensor from sensitively measuring the temperature of air.

However, as described above, in the case in which the sensor is located between the evaporator 451 and the condenser 453, the evaporator 451 may serve as a filter to catch the impurities even if the impurities are introduced into the evaporator 451. Consequently, this arrangement may prevent problems caused when the sensor is located in front of the evaporator 451.

The laundry treatment apparatus 100 may further include fasteners 7, 81 and 83, which serve to prevent damage to the hot air supply device 4 due to external shock during transportation of the laundry treatment apparatus 100 or operation of the laundry treatment apparatus 100 and to reduce vibration to be applied to the hot air supply device 4.

Figure 9A:
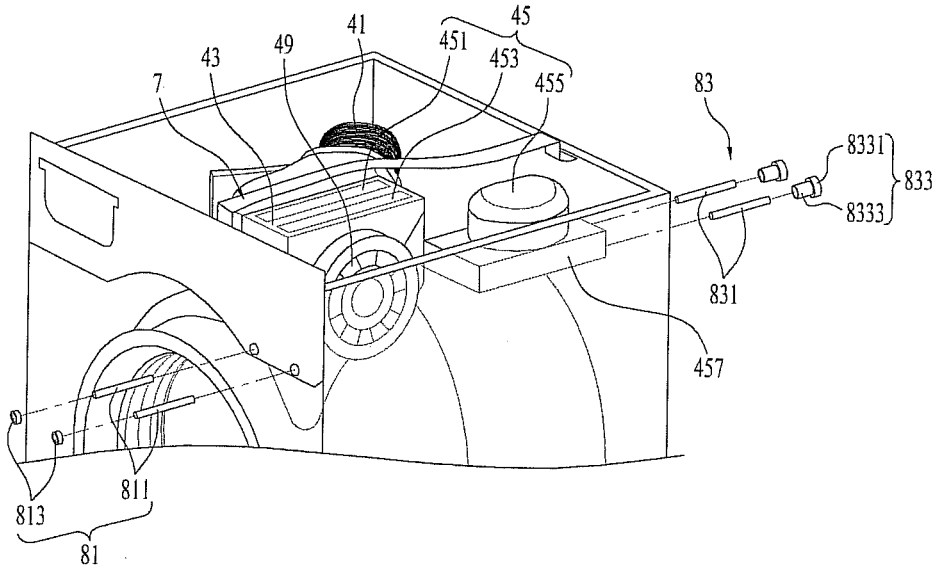
FIGS. 9A-9B and 10 are perspective views including a fastening device according to embodiments as broadly described herein.

As shown in FIG. 9A, the fasteners 7, 81 and 83 may be fixed to the cabinet 1 to secure the hot air supply device 4 to an upper surface of the tub 2.

The fasteners may include a pressure member 7 that applies pressure to the hot air supply device 4 toward the tub 2, and support members 81 and 83 to support the bottom of the hot air supply device 4.

Figure 9B:
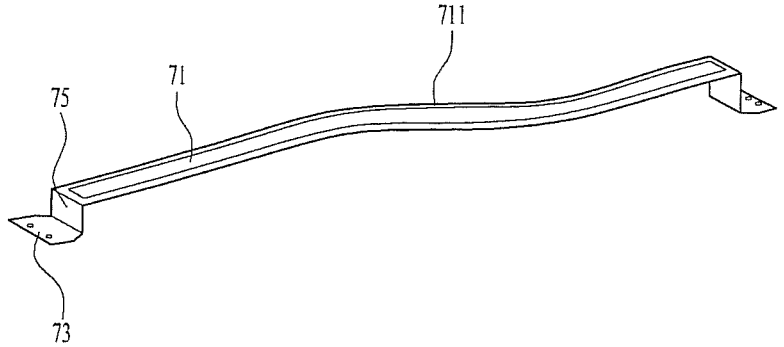

The pressure member 7 may be located on the hot air supply unit 4. One end of the pressure member 7 may be fixed to a front surface of the cabinet 1 and the other end of the pressure member 7 may be fixed to a rear surface of the cabinet 1. As such, the pressure member 7 may prevent the hot air supply device 4 from being separated from the upper surface of the tub 2 by external force. The pressure member 7, as shown in FIG. 9B, may include a bar-shaped pressure body 71, and fastening pieces 73 respectively located at opposite ends of the pressure body 71 and fastened to the cabinet 1. The pressure body 71 may be fixed to the cabinet 1 via the fastening pieces 73, thereby supporting an upper surface of the connection duct 43 or being fixed to the upper surface of the connection duct 43.

The pressure body 71 may include a bent portion 711 to prevent the pressure body 71 from coming into contact with the compressor 455. This is because, if the pressure body 71 comes into contact with the compressor 455, vibration generated in the compressor 455 may be transmitted to the cabinet 1 through the pressure body 71, thereby causing noise or vibration.

In certain embodiments, the bent portion 711 may not be provided at the pressure body 71, depending on the arrangement of the hot air supply device 4 and other devices located above the tub 2.

The pressure member 7 may further include flange portions 75 provided at opposite ends of the pressure body 71 to increase the strength of the pressure body 71. A pair of flange portions 75 may be arranged in a longitudinal direction of the pressure body 71.

The above-described pressure member 7 may be located above the connection duct 43, and may prevent the hot air supply device 4 from being moved away from the tub 2. However, the pressure member 7 cannot prevent transmission of vibration from the tub 2 to the hot air supply device 4. Accordingly, the fasteners may include the support members 81 and 83 configured to maintain a constant gap between a lower surface of the hot air supply device 4 and the tub 2. The support members may include first support members 81 secured to the cabinet 1 to support the connection duct 43 or the blower 49 and/or second support members 83 configured to secure the compressor support member 457 to the cabinet 1. The first support members 81 may be located in a space between the upper surface of the tub 2 and a lower surface of the circulation path 41, 43 and 45. The first support members 81 may include support bars 811 configured to secure the connection duct 43 or the blower 49 to the cabinet 1.

One or more support bars 811 may be provided. Provision of two or more support bars 811 may provide more stable support to the connection duct 43 or the blower 49. Each of the support bars 811 may penetrate the cabinet 1 at a position above the door 13, and a first vibration insulator 813 may be provided at a circumferential surface of the support bar 811 coming into contact with the cabinet 1 to prevent vibration of the hot air supply device 4 from being transmitted to the cabinet 1 and to prevent vibration of the cabinet 1 generated during transportation of the laundry treatment apparatus 100 from being transmitted to the hot air supply device 4.

For efficient vibration absorption, the first vibration insulator 813 may be formed of ethylene propylene diene monomer (EPDM) rubber, but it is unnecessary to limit the material of the first vibration insulator 813 to the aforementioned EPDM rubber so long as the first vibration insulator 813 may provide the above-described function.

Figure 10:
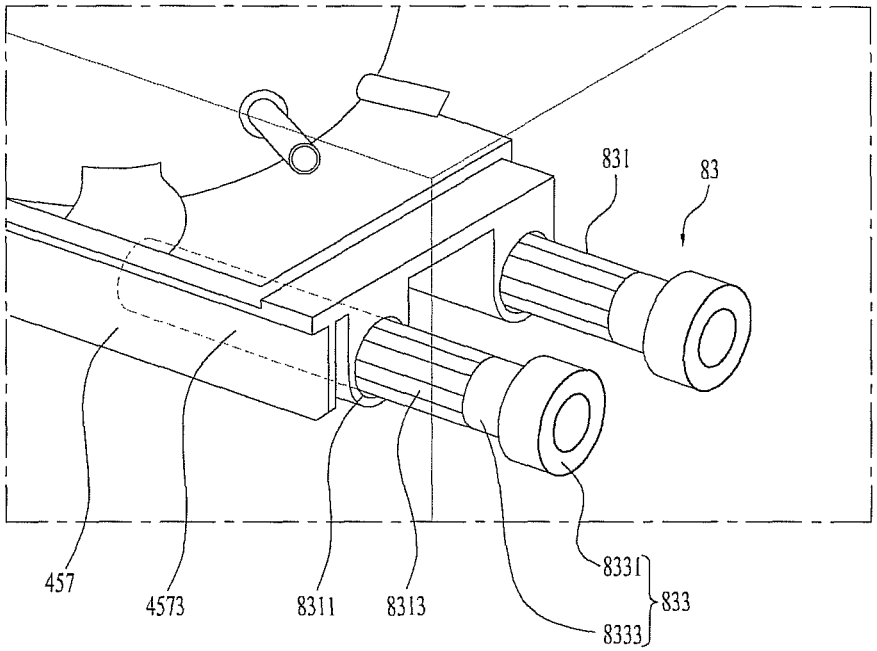

The second support members 83 may secure the compressor support member 457 to the cabinet 1. The second support members 83 may include compressor support bars 831 and second vibration insulators 833. As shown in FIG. 10, each of the compressor support bars 831 may penetrate the rear surface of the cabinet 1 and may be inserted into a hole 4573 formed in the compressor support member 457. One or more compressor support bars 831 may be provided, and two or more compressor support bars 831 may more stably support the compressor 455.

The compressor support bar 831 may include a support bar body 8311 inserted into the hole 4573, and a body flange 8313 protruding from an outer circumferential surface of the support bar body 8311 to come into contact with the hole 4573.

The second vibration insulator 833 may be provided on a circumferential surface of the compressor support bar 831 coming into contact with the cabinet 1. The second vibration insulator 833 may include a cabinet coupling portion 8331 coupled to the cabinet 1 and a bar through-hole 8333 perforated in the cabinet coupling portion 8331 such that the compressor support bar 831 is inserted into the bar through-hole 8333.

For efficient vibration absorption, the second vibration insulator 833 may be formed of EPDM rubber, but it is unnecessary to limit the material of the second vibration insulating portion to the EPDM rubber.

In certain embodiments, the laundry treatment apparatus 100 may include a first controller 911 to control at least one of rotation of the drum 3, supply and drainage of wash water, and/or the control panel 15, and a second controller 931 to control operation of the hot air supply device 4, the first controller 911 and the second controller 931 being separate from each other.

Figure 11:
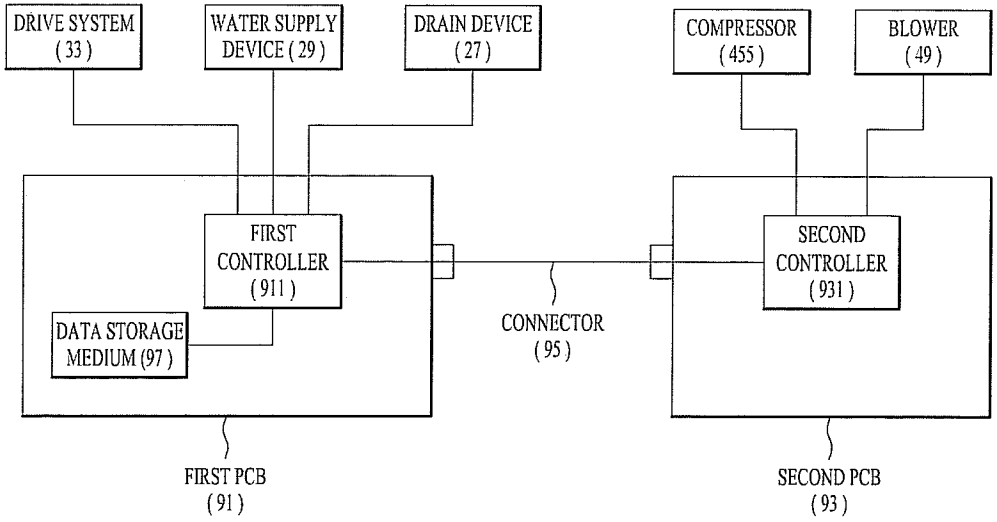
FIG. 11 is a block diagram of a controller according to embodiments as broadly described herein.

FIG. 11 shows one example of the first controller 911 for control of rotation of the drum 3 and control of supply and drainage of wash water (control of the water supply valve and the drain valve) and the second controller 931 for control of operation of the hot air supply device 4.

The use of two controllers 911 and 931 may prevent deterioration in the performance of the laundry treatment apparatus 100 caused when a main controller suffers from overload of data to be processed when the single main controller has to control all of a drive system (e.g., the motor 33 provided for rotation of the drum 3), the water supply and drain devices 27 and 29 of the tub 2, and the hot air supply device 4.

That is, the first controller 911 mainly controls a washing cycle for washing of laundry via control of the drive system 33 and the water supply and drain devices 27 and 29 (i.e. a cycle during which contaminants of laundry are separated via rotation of the drum 3 and supply and drainage of wash water), and the second controller 931 mainly controls a drying cycle for drying of laundry via control of the hot air supply device 4 (i.e. a cycle during which hot air is supplied to laundry via the heat exchanger 45 and the blower 49).

The first controller 911 may be set to function as a main controller that controls a power supply device of the laundry treatment apparatus 100, and the input device 151 and the display device 153 provided at the control panel 15 (for control of power supply and power down).

However, in the case of the laundry treatment apparatus capable of washing and drying laundry, operation of the laundry treatment apparatus may terminate when the drying cycle terminates, and therefore control of the power supply device may be conducted by the second controller 931.

In the laundry treatment apparatus 100, the first controller 911 and the second controller 931 may be physically separated from each other by a first printed circuit board (PCB) 91 and a second PCB 93.

The first PCB 91 may be integrally mounted to the control panel 15, and the second PCB 93 may be disposed on the control panel 15 and be separably coupled to the first PCB 91. The controllers 911 and 931 mounted on the respective PCBs 91 and 93 may be electrically connected to each other via a connector 95. That is, the first PCB 91 and the second PCB 93 included in the laundry treatment apparatus 100 may be separable from each other, and may be connected to each other via the connector 95 to enable data exchange (data communication) between the first controller 911 and the second controller 931 as needed. In this way, as the hot air supply device 4 and the second PCB 93 are added to a laundry treatment apparatus including only the drive device 33, the water supply and drain devices 27 and 29, and the first PCB 91, the laundry treatment apparatus designed to implement only a washing function may be modified into a laundry treatment apparatus capable of implementing a drying function as well as the washing function.

In addition, as the second PCB 93 is added to a laundry treatment apparatus including only the drive system 33, the water supply and drain devices 27 and 29, the first PCB 91 provided with the first controller 911 and the hot air supply device 4, the laundry treatment apparatus in which the hot air supply device 4 is controlled by the first controller 911 may be modified in such a manner that the hot air supply device 4 is controlled by the second controller 931.

Examples of data transmitted from the first controller 911 to the second controller 931 may include data regarding whether or not a washing cycle has terminated and data regarding the quantity of laundry stored in the drum 3 (laundry quantity data). Examples of data transmitted from the second controller 931 to the first controller 911 may include a signal indicating termination of operation of the hot air supply device 4, the temperature of air to be supplied into the tub 2, and dryness of laundry stored in the drum 3.

The first controller 911 may display the data transmitted from the second controller 931 on the display device 153 provided at the control panel 15 as needed.

In addition, examples of data exchanged between the first controller 911 and the second controller 931 may include an operation request signal of the first controller 911 and an operation request signal of the second controller 931.

More specifically, during implementation of a washing cycle, the first controller 911 may transmit a signal to request the second controller 931 for temporary operation of the hot air supply device 4. During implementation of a drying cycle, the second controller 931 may transmit a signal to request the first controller 911 for temporary operation of the drive system 33 or the water supply and drain devices 27 and 29.

Any one of the first PCB 91 or the second PCB 93 may include a data storage medium 97 in which control data for implementation of a washing cycle (control data for the drive system 33 and the water supply and drain devices 27 and 29) and control data for implementation of a drying cycle (control data for the hot air supply device 4).

If the first controller 911 that functions as a main controller of the laundry treatment apparatus 100 is provided at the first PCB 91, the data storage medium 97 may be provided at the first PCB 91. As described above, if the first controller 911 functions as a main controller and the first PCB 91 includes the data storage medium 97, the second controller 931 may share the data storage medium 97 provided at the first PCB 91 because the second PCB 93 may be selectively coupled to the first PCB 91 as needed.

Hereinafter, a control method of the laundry treatment apparatus 100 according to the present invention will be described.

Figure 12:
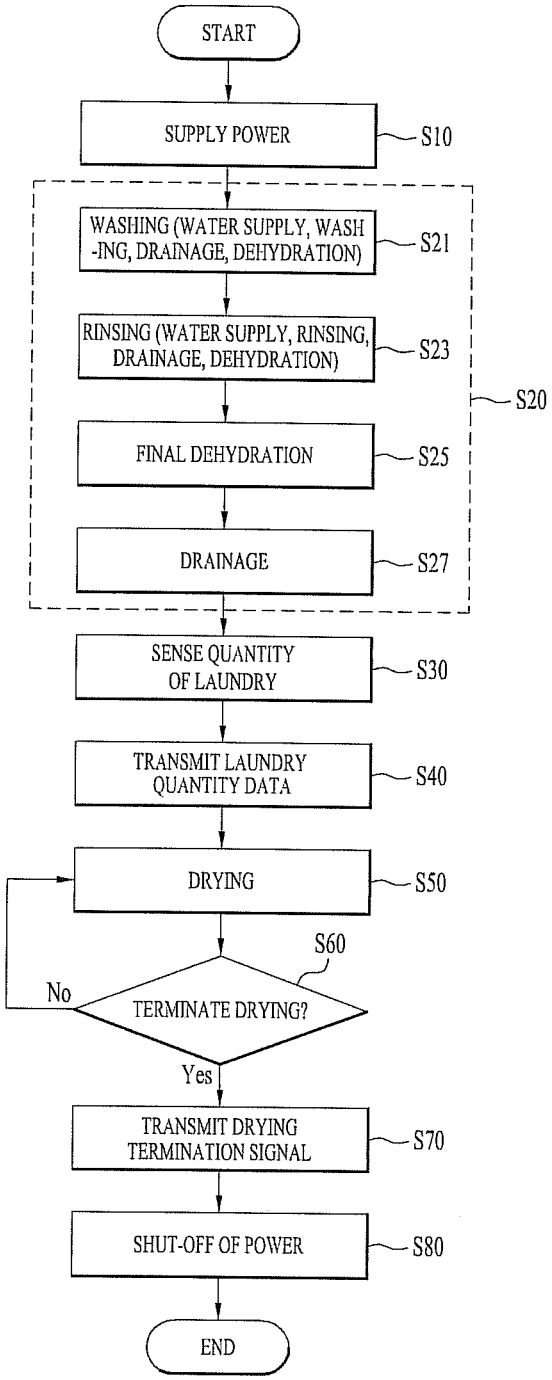
FIG. 12 is a flow chart of a control method of a laundry treatment apparatus according embodiments as broadly described herein.

As shown in FIG. 12, when the user selects a washing cycle (or a drying cycle) or inputs a power supply instruction to the laundry treatment apparatus 100 via the input device 151 provided at the control panel 15, the first controller 911 supplies power to the respective components of the laundry treatment apparatus 100 (S10).

A washing cycle may then be conducted (S20) a washing step (S21), a rinsing step (S23), a dehydration step (S25), and a drainage step (S27).

The washing step S21 may include a water supply process, a washing process, a drainage process, and a dehydration process. The water supply process may be conducted as the first controller 911 supplies wash water into the tub 2 via the water supply device 29. In the water supply process, the first controller 911 may control the water supply device 29 to supply a predetermined quantity of wash water for the washing cycle selected by the user into the tub 2. The washing process may be conducted when the supply of wash water into the tub 2 terminates. During the washing process, the first controller 911 may rotate the drum 3 via the drive system 33. Then, the drainage process may be conducted as the first controller 911 controls the drain device 27 to discharge wash water from the tub 2, and the dehydration process may be conducted as the first controller 911 rotates the drum 3 via the drive system 33.

After termination of the washing step S21, the rinsing step S23 may be conducted. The rinsing step S23 may include a water supply process, a rinsing process, a drainage process, and a dehydration process. The water supply, drainage, and dehydration processes of the rinsing step S23 may be essentially the same as the water supply, drainage, and dehydration processes of the washing step S21, and the rinsing process of the rinsing step S23 may be essentially the same as the washing process of the washing step S21. Thus, further detailed description of the rinsing step S23 will be omitted.

After termination of the rinsing step S23, a final dehydration step S25 and a final drainage step S27 may be conducted.

The final dehydration step S25 may be conducted as the first controller 911 rotates the drum 3 via the drive system 33 to discharge water contained in laundry. The final drainage step S27 may be conducted as the first controller 911 controls the drain device 27 to discharge wash water from the tub 2.

The final dehydration step S25 and the final drainage step S27 may be conducted in sequence as shown in FIG. 12, or, in alternative embodiments may be simultaneously conducted.

After termination of the washing cycle S20, a laundry quantity sensing cycle S30 may be performed to determine the quantity/amount of laundry stored in the drum 3 as the first controller 911 rotates the drum 3 via the drive system 33.

When the amount of laundry is determined in the laundry quantity sensing cycle S30, the first controller 911 transmits data regarding the sensed amount of laundry (laundry quantity data) to the second controller 931 (S40). Then, a drying cycle S50 may be conducted as the second controller 931 controls the hot air supply device 4 based on the laundry quantity data transmitted from the first controller 911.

That is, during the drying cycle (S50), the second controller 931 controls, e.g., operation time of the heat exchanger 45 and the blower 49, and the temperature of hot air to be supplied into the tub 2 based on the laundry quantity data transmitted from the first controller 911.

During of the drying cycle (S50), the second controller 931 determines whether or not laundry reaches target dryness (S60). Determination of dryness (S60) may be conducted as a sensor measures data regarding the temperature and humidity of air discharged from the tub 2 and the second controller 931 compares the data transmitted from the sensor with predetermined reference data on a per laundry quantity basis.

Note that the second controller 911 may set operation time of the hot air supply device 4 based on the laundry quantity data transmitted from the first controller 911. Therefore, determination of dryness (S60) may be conducted by determining whether or not predetermined operation duration of the heat exchanger 45 and the blower 49 has elapsed.

In this case, when the predetermined operation time of the heat exchanger 45 and the blower 49 has elapsed, the second controller 931 transmits a signal indicating termination of operation of the hot air supply device 4 to the first controller 911 (S70).

If the first controller 911 receives the signal indicating termination of operation of the hot air supply device 4 from the second controller 931, the first controller 911 shuts off power to the laundry treatment apparatus 100 (S80). Shut-off of power to the laundry treatment apparatus (S80) may include shutting off power to the drive system 33 and the water supply and drain devices 27 and 29 by the first controller 911. In addition, before implementing shut-off of power to the laundry treatment apparatus S80, the first controller 911 may indicate to the user that operation of the laundry treatment apparatus 100 is to be terminated via the display device 153 provided at the control panel 15 or a speaker. Shut-off of power to the laundry treatment apparatus (S80) may be conducted by the second controller 931.

A laundry treatment apparatus as embodied and broadly described herein may be capable of achieving high drying efficiency.

A laundry treatment apparatus as embodied and broadly described herein may be capable of achieving high heat exchange efficiency by allowing air moved by a blower to pass through an entire region of a heat exchanger In a laundry treatment apparatus as embodied and broadly described herein a hot air supply device located above a laundry accommodation space in which laundry is received, whereby increase in the volume of the laundry treatment apparatus may be minimized.

A laundry treatment apparatus as embodied and broadly described herein may be capable of ensuring automated cleaning of a filter device that serves to filter air to be supplied into a heat exchanger.

A laundry treatment apparatus as embodied and broadly described herein may include a filter device that may be withdrawn through a control panel.

A laundry treatment apparatus, as embodied and broadly described herein, may include a cabinet defining an external appearance of the apparatus, the cabinet having a laundry opening, a laundry accommodation unit placed within the cabinet and configured to accommodate laundry introduced through the laundry opening, a hot air supply unit including a circulation path configured to guide air discharged from the laundry accommodation unit and resupply the air into the laundry accommodation unit, a heat exchanger placed in the circulation path, and a blower configured to circulate the interior air of the laundry accommodation unit through the circulation path, and a filter unit located in the circulation path to filter the air to be moved to the heat exchanger, the filter unit being withdrawn from the circulation path by passing through the cabinet.

The laundry treatment apparatus may further include a filter separation/coupling passage configured to penetrate the cabinet, and a filter guide connecting the filter separation/coupling passage and the circulation path to each other, the filter guide being configured to guide the filter unit into the circulation path.

The filter separation/coupling passage may be located above the laundry opening.

The filter unit may include a body located in the filter guide, and a filter frame extending from the body so as to be located in the circulation path, the filter frame being configured to support a filter, by which impurities are caught.

The filter frame may include a first frame fixed to the body, the first frame having a first filter configured to filter air, and a second frame rotatably and separably coupled to the first frame, the second frame having a second filter configured to filter air.

At least one of the body and the filter frame may be an elastic member.

The body may include a handle received in the filter separation/coupling passage, and an elastic support portion connecting the handle and the body to each other to elastically support the body.

The laundry treatment apparatus may further include an impurity removal unit configured to remove impurities remaining on the filter.

The impurity removal unit may include a scraper installed to the filter guide to separate impurities remaining on the filter from the filter when the filter frame is withdrawn from or inserted into the circulation path.

The circulation path may guide the air from a rear region of the laundry accommodation unit to a front surface of the laundry accommodation unit, the front surface being oriented to face the laundry opening.

The circulation path may include a suction duct, into which the interior air of the laundry accommodation unit is introduced, the suction duct being fixed to a rear surface of the laundry accommodation unit, a discharge duct from which the air is discharged into the laundry accommodation unit, the discharge duct being fixed to the front surface of the laundry accommodation unit, and a connection duct connecting the suction duct and the discharge duct to each other, the heat exchanger being located in the connection duct, and the blower may be located between the heat exchanger and the discharge duct.

The laundry accommodation unit may include a cylindrical tub placed within the cabinet and configured to store wash water therein, the tub having a tub opening facing the laundry opening, a drum rotatably placed within the tub and configured to accommodate laundry introduced through the tub opening, and a gasket configured to connect the tub opening and the laundry opening to each other so as to prevent leakage of wash water from the tub.

The suction duct may be fixed to an upper portion of a circumferential surface of the tub, and the discharge duct may be fixed to the gasket.

The suction duct and the gasket may be vibration insulating members.

The circulation path may be fixed to an upper portion of an outer circumferential surface of the laundry accommodation unit and may serve as a vibration insulating member for the heat exchanger and the laundry accommodation unit.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus, comprising:

a cabinet having a laundry opening formed therein;

a laundry receiving device provided in the cabinet and configured to receive laundry therein through the laundry opening formed in the cabinet;

a hot air supply device, including:

a circulation passage configured to guide air discharged from the laundry receiving device and to resupply the air back into the laundry receiving device;

a heat exchanger provided in the circulation passage; and a blower configured to circulate air from an interior of the laundry receiving device through the circulation passage and back into the laundry receiving device;

a filter device positioned in the circulation passage to filter air flowing to the heat exchanger, wherein the filter device is removable from the circulation passage through a corresponding portion of the cabinet;

a filter separation/coupling passage that penetrates the cabinet; and a filter guide that connects the filter separation/coupling passage and the circulation passage, wherein the filter guide is configured to guide the filter device into and out of the circulation passage, and wherein the filter separation/coupling passage is closed when the filter device is inserted into the circulation passage, and the filter separation/coupling passage is opened when the filter device is removed from the circulation passage.

2. The apparatus according to claim 1, wherein the filter separation/coupling passage is positioned above the laundry opening formed in the cabinet.

3. The apparatus according to claim 2, wherein the filter device includes:

a filter body provided in the filter guide;

a filter frame that extends from the filter body into the circulation passage; and a filter supported in the filter frame to catch impurities in air flowing through the circulation passage.

4. The apparatus according to claim 3, wherein the filter frame includes:

a first frame fixed to the filter body, wherein the first frame supports a first filter configured to filter air; and a second frame rotatably and separably coupled to the first frame, wherein the second frame supports a second filter configured to filter air.

5. The apparatus according to claim 3, wherein at least one of the body or the filter frame is an elastic member.

6. The apparatus according to claim 3, wherein the filter device further includes:

a handle received in the filter separation/coupling passage; and an elastic support portion that connects the handle and the filter body to elastically support the filter body.

7. The apparatus according to claim 3, further including an impurity removal device configured to remove impurities accumulated on the filter.

8. The apparatus according to claim 7, wherein the impurity removal device includes a scraper coupled to the filter guide to separate impurities from the filter as the filter frame is withdrawn from or inserted into the circulation passage.

9. The apparatus according to claim 1, wherein the circulation passage guides air out of the laundry receiving device from a rear region of the laundry receiving device and back into the laundry receiving device at a front region of the laundry receiving device, the front region being oriented to face the laundry opening.

10. The apparatus according to claim 9, wherein the circulation passage includes:

a suction duct fixed to a rear surface of the laundry receiving device, wherein the suction duct guides air from an interior of the laundry receiving device into the circulation passage;

a discharge duct fixed to a front surface of the laundry receiving device, wherein the discharge duct discharges air from the circulation passage back into the laundry receiving device; and a connection duct that connects the suction duct and the discharge duct, wherein the heat exchanger is positioned in the connection duct, and the blower is positioned between the heat exchanger and the discharge duct.

11. The apparatus according to claim 10, wherein the laundry receiving device includes:

a cylindrical tub provided in the cabinet, the tub having a tub opening that faces the laundry opening formed in the cabinet;

a drum rotatably provided in the tub and configured to receive laundry therein through the tub opening; and a gasket that extends between the tub opening and the laundry opening so as to prevent leakage of wash water from the tub.

12. The apparatus according to claim 11, wherein the suction duct is fixed to an upper circumferential surface of the tub, and the discharge duct is fixed to the gasket.

13. The apparatus according to claim 12, wherein the suction duct and the gasket are vibration insulating members.

14. The apparatus according to claim 1, wherein the circulation passage is fixed to an upper outer circumferential surface of the laundry receiving device and provides vibration insulation for the heat exchanger and the laundry receiving device.

15. The apparatus according to claim 4, wherein the first frame is rotatably coupled to the second frame via a hinge.

16. The apparatus according to claim 4, wherein the first frame and the second frame are arranged to face each other.

17. The apparatus according to claim 4, wherein the filter device further includes frame coupling portions that secures the first frame to the second frame.

18. The apparatus according to claim 17, wherein the frame coupling portions include:

a boss provided on the filter body; and a receiving recess provided in the second frame.

19. The apparatus according to claim 6, wherein the elastic support portion includes a plurality of corrugations that forms at least one surface of the filter body.

20. The apparatus according to claim 8, wherein the scraper includes:

a first scraper connected the filter guide to come into contact with the first filter; and a second scraper connected to the filter guide to come into contact with the second filter.

* * * * *